US006513881B2

(12) United States Patent
Pope

(10) Patent No.: US 6,513,881 B2
(45) Date of Patent: Feb. 4, 2003

(54) APPARATUS FOR REMOVING A FLOOR COVERING

(76) Inventor: Donald A. Pope, 118 S. Cherry St., Ocilla, GA (US) 31774

( * ) Notice: Subject to any disclaimer, the term of this patent is extended or adjusted under 35 U.S.C. 154(b) by 0 days.

(21) Appl. No.: 09/757,775

(22) Filed: Jan. 9, 2001

(65) Prior Publication Data

US 2001/0022463 A1 Sep. 20, 2001

Related U.S. Application Data

(63) Continuation-in-part of application No. 09/528,767, filed on Mar. 17, 2000, now Pat. No. 6,273,513, which is a continuation-in-part of application No. 09/354,260, filed on Jul. 15, 1999, now abandoned.

(60) Provisional application No. 60/098,816, filed on Sep. 2, 1998.

(51) Int. Cl.[7] ..... A47L 13/02

(52) U.S. Cl. ..... 299/36.1; 15/93.1; 30/170

(58) Field of Search ..... 299/36.1, 37.1; 30/169, 170; 15/93.1

(56) References Cited

U.S. PATENT DOCUMENTS

| | | | | |
|---|---|---|---|---|
| 3,647,005 A | | 3/1972 | Boyd | |
| 4,009,908 A | | 3/1977 | Alinder et al. | |
| 4,063,608 A | * | 12/1977 | Sullivan | 180/215 |
| 4,088,369 A | | 5/1978 | Prater | |
| 4,162,809 A | | 7/1979 | Anderson et al. | |
| 4,626,033 A | | 12/1986 | Anderson | |
| 4,963,224 A | | 10/1990 | Anderson | |
| 4,981,548 A | | 1/1991 | Poll | |
| 5,037,160 A | | 8/1991 | Ukai | |
| 5,082,330 A | | 1/1992 | Holder | |
| 5,197,784 A | | 3/1993 | Holder | |
| 5,408,765 A | * | 4/1995 | Lozensky | 37/231 |
| 5,641,206 A | | 6/1997 | Craft | |
| 5,702,161 A | | 12/1997 | Finney et al. | |
| 5,713,637 A | | 2/1998 | Worden et al. | |
| 5,772,284 A | | 6/1998 | Lindsey et al. | |
| 5,830,313 A | | 11/1998 | Smith | |
| 6,170,242 B1 | * | 1/2001 | Gordon | 56/15.8 |
| 6,299,257 B1 | * | 10/2001 | Constantino | 299/36.1 |

* cited by examiner

*Primary Examiner*—David Bagnell
*Assistant Examiner*—Sunil Singh
(74) *Attorney, Agent, or Firm*—Brian D. Bellamy

(57) ABSTRACT

An apparatus for removing at least one surface layer from a floor. The apparatus includes a body frame mountable by a machine operator. A blade tool assembly having a scraping blade is secured to the front of the main body frame and can be used for removing floor covering. The blade tool may be replaced by a detachable transport wheel for moving the machine when not in use for removing floor covering. A pair of independent suspensions is attached to the rear end of the frame, and independent drive motors and wheels for moving the frame and blade tool with respect to the floor surface attach to each suspension. The independent suspensions include a pivot shaft attached to the frame with a suspension bar that supports the drive motor attached to each pivot shaft. Shock absorbers are attached to the suspension bar and to the rear end of the frame such that the rear of the apparatus adjusts when the apparatus encounters debris or irregular floor surfaces.

4 Claims, 6 Drawing Sheets

APPARATUS FOR REMOVING A FLOOR COVERING

This application is a continuation-in-part application and claims the benefit of U.S. application Ser. No. 09/528,767, filed Mar. 17, 2000 and entitled APPARATUS FOR REMOVING A FLOOR COVERING, now U.S. Pat. No. 6,273,513, which is a continuation-in-part and claimed the benefit of U.S. application Ser. No. 09/354,260, filed Jul. 15, 1999, now abandoned, which claimed the benefit of U.S. Provisional Application No. 60/098,816, filed on Sep. 2, 1998.

BACKGROUND OF THE INVENTION

The present invention relates to operator mounted machines for removal and demolition of at least one layer of floor covering on a floor. The types of floor coverings that the present machine will remove include, but are not limited to, carpet, vinyl tile, ceramic tile, wood, stone, and other floor coverings that are generally found in residential and commercial buildings.

Floor coverings are often removed in buildings that are being renovated or improved. Removal of floor coverings is usually a difficult and arduous task because the floor coverings are affixed to floors such that they will remain permanently. However in order to install a new floor covering, the prior floor covering usually must be removed. Removing a floor covering by hand is not a viable option because of the difficulty of the task and the amount of areas needed to be covered. Therefore, new improved methods of removing floor covering using operator mounted machines have been invented in which the machine is mounted by an operator who sits atop the machine and controls it during use. The operator mounted type of machine is advantageous in that it is generally safer and more efficient than other known floor covering removal machines.

Contractors often price floor covering removal jobs based upon the amount of time and labor expected to complete the work required. The floor covering removal apparatus of the prior art operator mounted machines utilize a front weight bearing wheel and hydraulically operated scraping blades that lengthen the apparatus. For example, an operator mounted apparatus for removing a surface layer from a floor is disclosed in U.S. Pat. No. 5,641,206, issued May 24, 1997 to David B. Craft. The Craft patent related to an apparatus that includes a front weight bearing wheel means, front and rear weight plates, and a hydraulic means for pivoting a support plate and scraping blade. The length of a floor removal apparatus is further increased by the addition of weight plates to the front of the apparatus as taught by the Craft patent. The greater length of a machine like those being discussed increases the area needed for maneuvering the machine, and an increased maneuvering area causes the machines to miss a greater amount of floor area during the floor covering removal process, thus leading to costly inefficiencies of time and labor.

A further problem exists during the removal process when the scraping blade does not remain flush against the floor causing the scraping blade to fail in penetrating and removing the floor covering. The present inventor has found that a primary cause of the scraping blade jumping or slipping out of operating position is that floor covering debris often collects in the path of a rear drive wheel of the machine. The buildup causes the rear wheel that rolls over the buildup to be raised with respect to the other rear wheel. The raised rear wheel changes the plane of the scraping blade, and the blade does not remain flush with the floor causing the blade to jump or slip when stripping floor covering. Prior art devices like that in the Craft patent do not address means for keeping the scraping blade flush with the floor surface when such debris builds up.

A similar problem is addressed by U.S. Pat. No. 5,772,284 to Lindsey et al., issued Jun. 30, 1998. The Lindsey patent relates to the use of a blade that is mounted to a bearing that changes the roll and pitch of the blade with respect to the floor. However, floor surfaces are generally flat, and it is important that any imperfections in floor surface coverings be removed. The blade in the Lindsey device adjusts to surface contours, adhesive deposits, and similar surface imperfections and may not cut through these imperfections in the floors surface covering.

Thus, while compact operator mounted machines are known for removing floor coverings, these known devices do not solve the problems discussed above.

Prior art apparatuses for removing floor covering do not eliminate the problems with scraping blade efficiency in the removal of floor coverings. When using known machines having scraping blades in fixed horizontal positions, the blades are caused to jump or slip by imperfections and by debris buildup beneath the rear wheels of an apparatus for removing floor covering. A solution to the problem of floor imperfections that teaches a rolling blade creates additional inefficiencies in that the blade may adjust to floor imperfections and contours rather than remove those imperfections. Therefore, it would be advantageous to provide a compact and maneuverable floor surface removal apparatus that would eliminate the problems with blade slippage caused by debris buildup beneath the rear wheels of the apparatus during operation.

SUMMARY OF THE INVENTION

The floor covering removal apparatus of the present invention provides more efficient removal of carpet, vinyl tile, ceramic tile, wood, stone, and other floor coverings from the floors of residential and commercial buildings. An object of the present invention is to provide a compact floor covering removal apparatus and to provide an apparatus in which the rear wheels of the machine adjust for debris buildups to assist the scraping blade in maintaining flush horizontal contact with the floor covering being removed.

In one embodiment of the invention, the apparatus comprises a machine body frame that is mounted by an operator. A pair of independent suspension assemblies is attached to the rear of the machine on each side. Each suspension assembly supports a drive means such that there is a right drive means and a left drive means that is driven by an integrated hydraulic pump system having a first hydraulic pump and a second hydraulic pump.

The suspension assemblies include pivot shaft assemblies that attach to the rear of the body frame. The outer cylinder of the pivot shaft assembly is attached to the frame. The pivot shaft assembly has a bearing and shaft therein. A suspension bar is pivotally connected to the shaft which is threaded on each end and secured at each end by a nut. The connection of each pivot shaft assembly to each suspension bar provides a means for the suspension bars to pivot with respect to the main body frame. A shock absorber is attached between the suspension bar and the frame body. The degree to which the suspension bars pivot about the pivot shaft assemblies is determined at least in part by the shock absorbers.

The right drive means and left drive means each includes a rear wheel that contacts the floor surface. As a wheel passes over debris on the floor surface, the shock absorbers give with respect to the weight of the main body frame. The main body frame remains fixed in horizontal relation to the floor surface and this maintains the flush horizontal contact of the scraping blade with the floor surface.

To provide adequate penetration of the blade into the floor covering material, additional weight may be added. The present apparatus provides for the operator to vary the pressure within the shock absorbers to adjust to conditions that may be encountered. In addition, the pressure in a shock absorber on one side may be adjusted to change the horizontal angle of the blade with respect to a surface. For more uniform addition of weight to assist the blade in cutting tough floor surfaces, weight plates may be added to weight supporting means on both sides of the machine body, thereby reducing the required length of the apparatus.

Further, a means is provided for transporting the apparatus comprising a detachable front wheel. When, the apparatus is in use for removing floor covering, the front wheel is removed to further reduce the length of the apparatus and improve the apparatus maneuverability. Adding to the safety of the apparatus, the front wheel attaches to the blade holder such that the blade must be removed when the front wheel is attached to the machine.

DETAILED DESCRIPTION OF THE INVENTION

Figure 1:
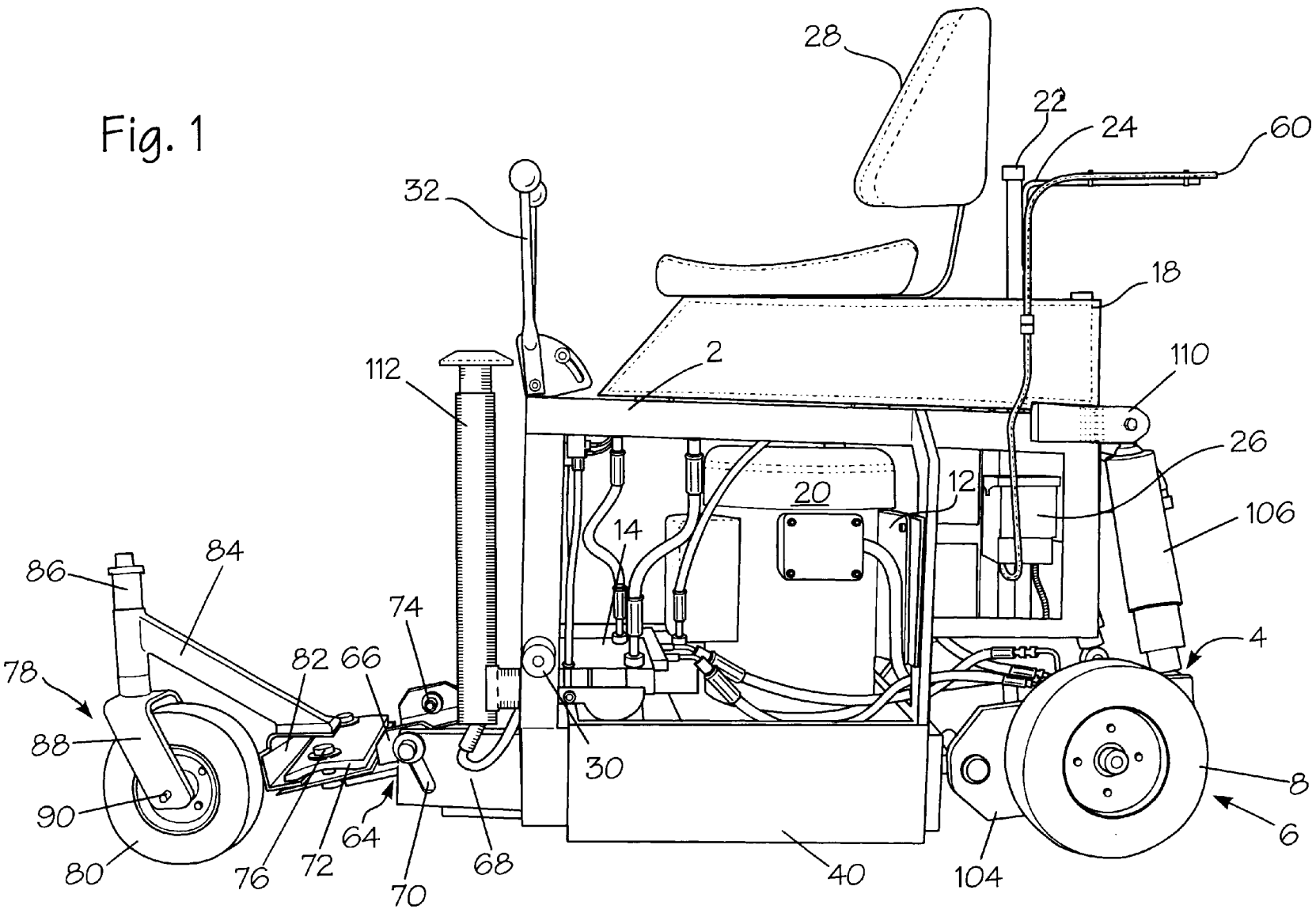
FIG. 1 is a side elevation view of the apparatus constructed in accordance with the present invention with a front wheel means attached thereto.
Figure 2:
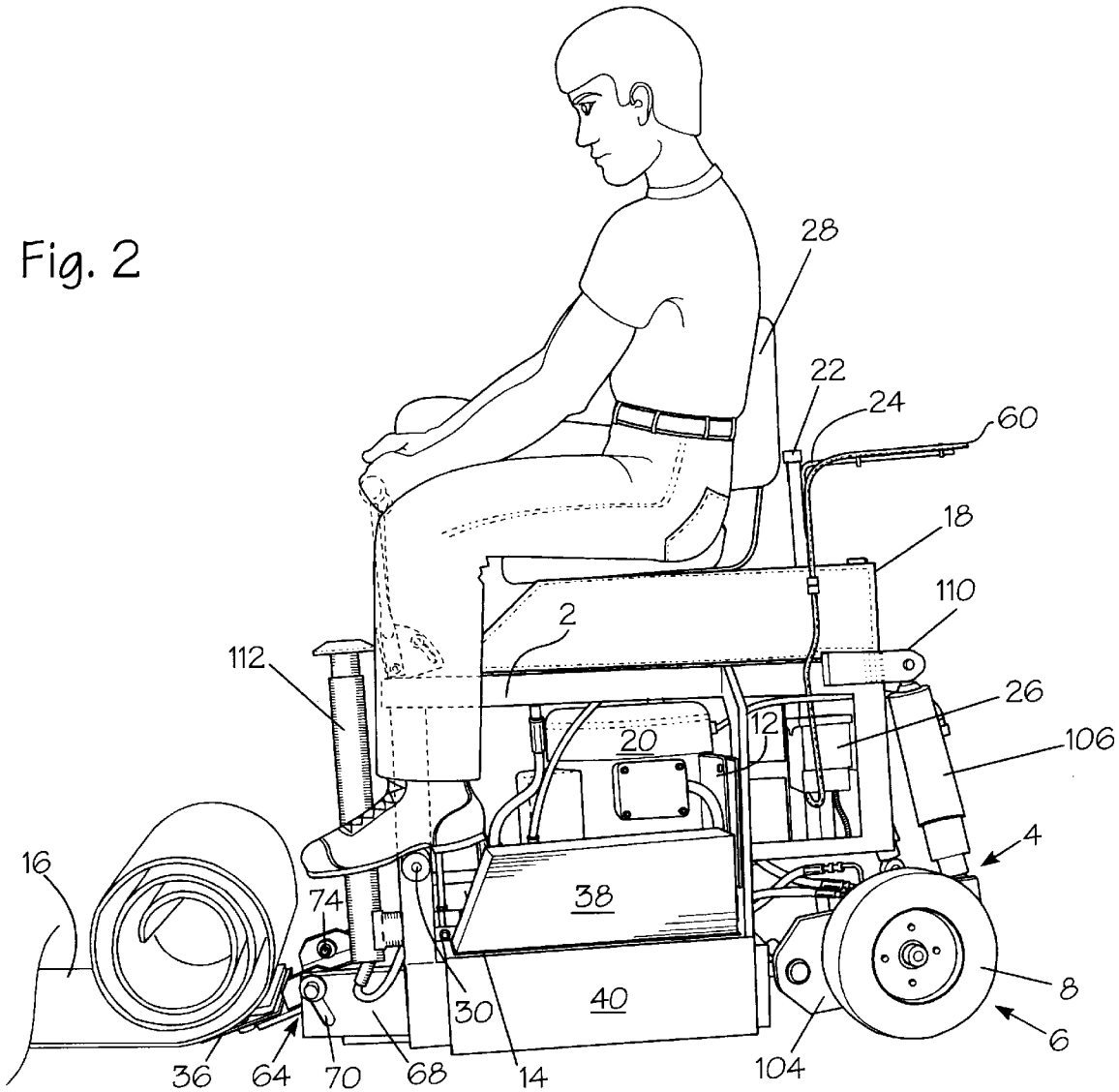
FIG. 2 is a side elevation view of the apparatus of the present invention in operation with the front wheel means detached and having weights added thereto.
Figure 3:
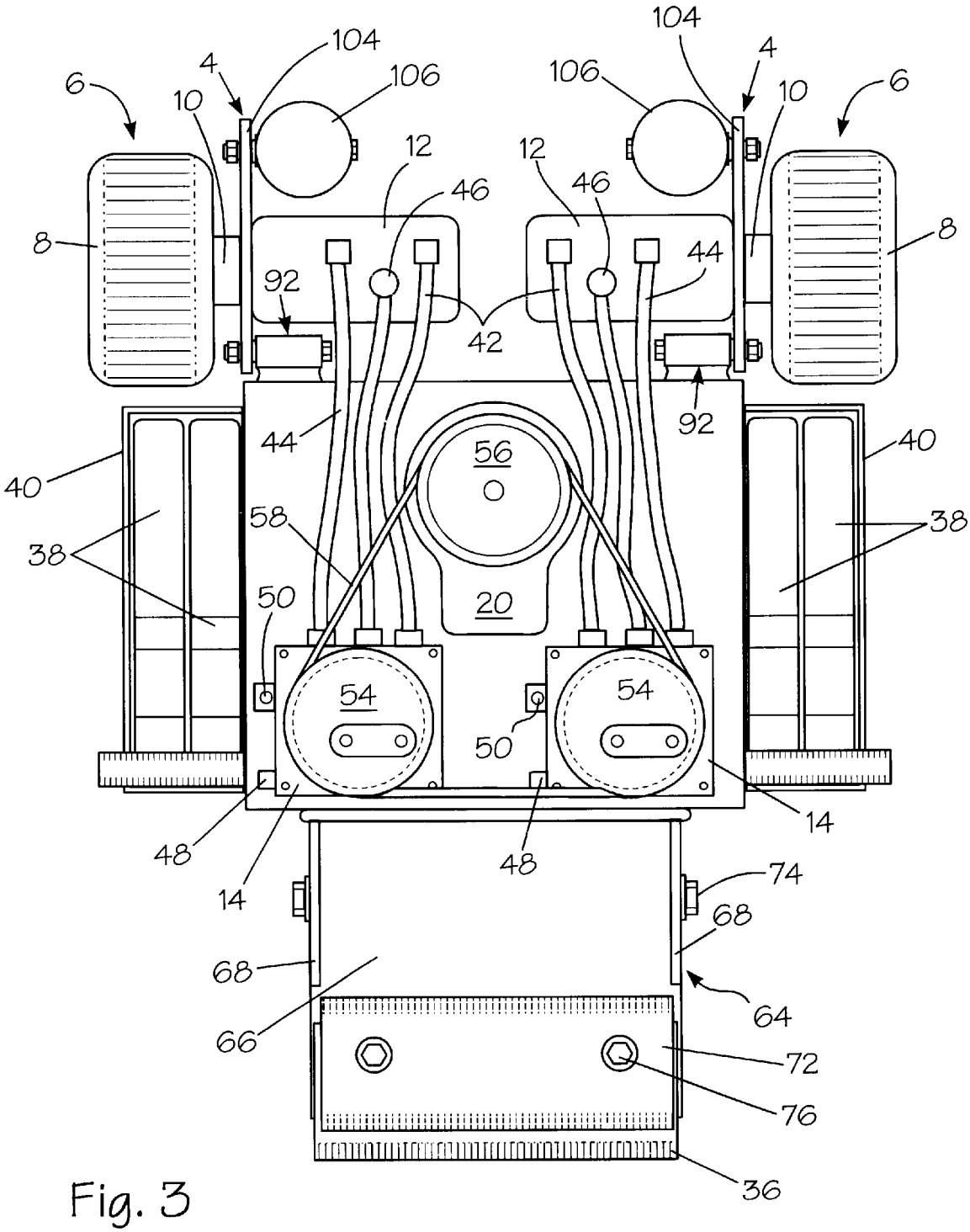
FIG. 3 is a cut away top view of the apparatus of FIG. 2.
Figure 4:
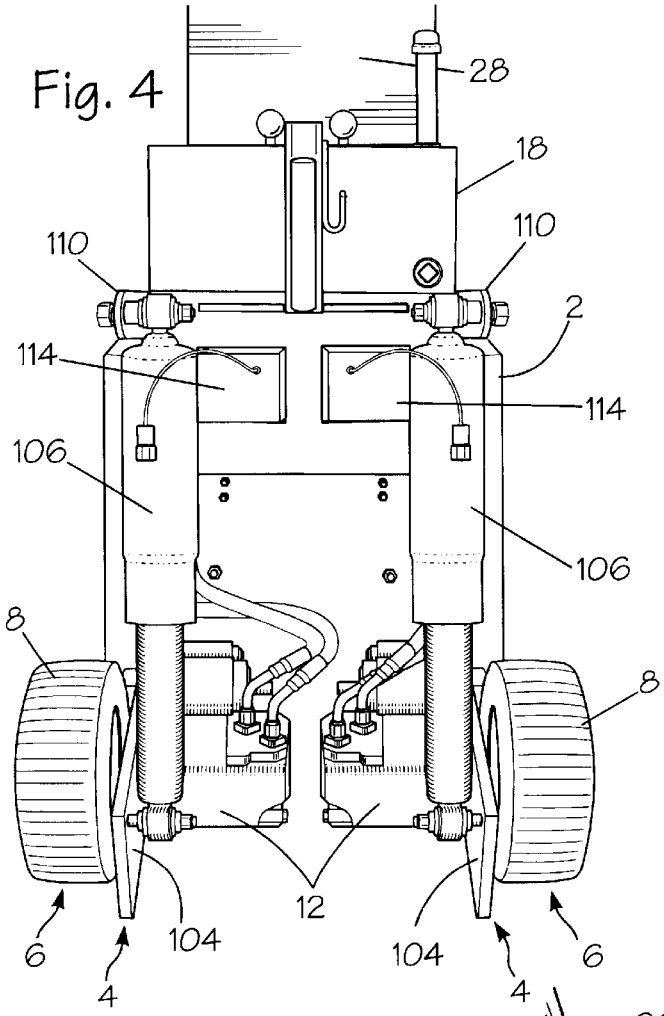
FIG. 4 is a rear view of the apparatus of FIG. 1.
Figure 5:
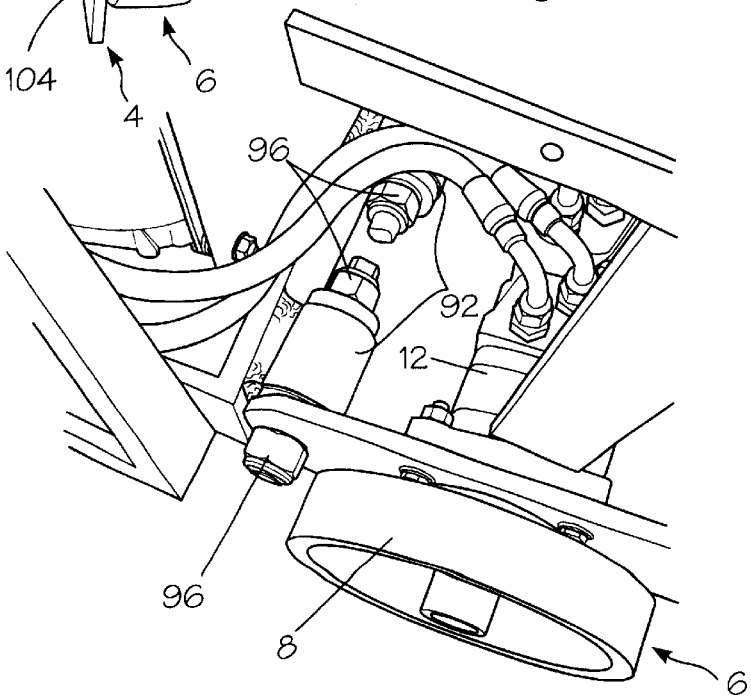
FIG. 5 is a sectional top elevation view of a floating rear wheel section constructed in accordance with the present invention.
Figure 6A:
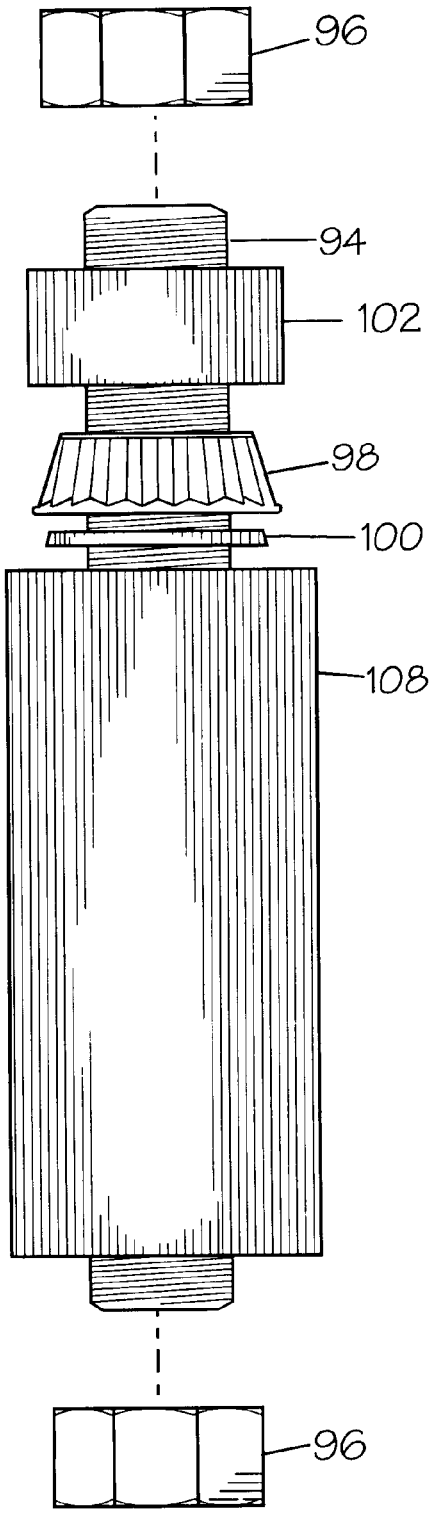
FIG. 6*a* is an assembly view of the pivot shaft assembly of the present invention.
Figure 6B:
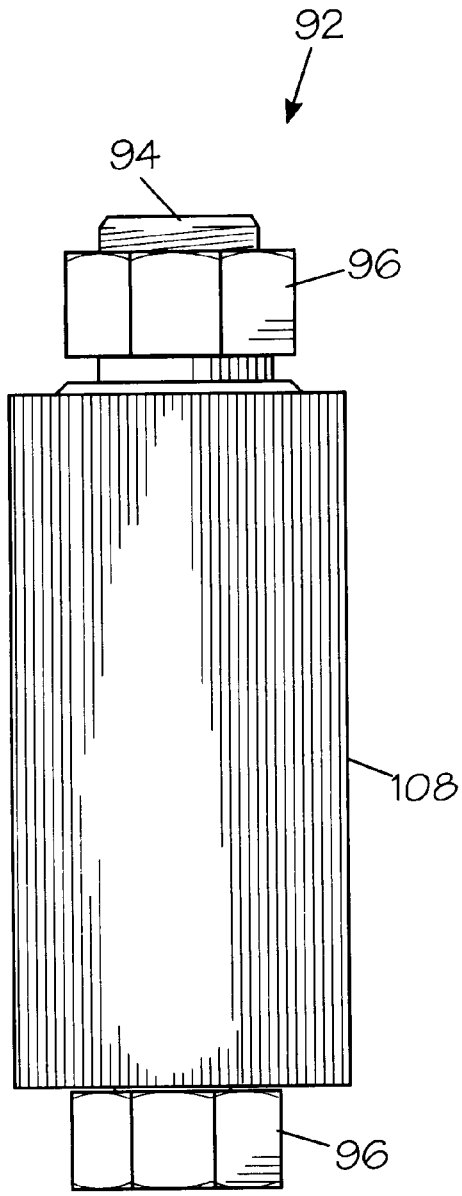
FIG. 6*b* is a top view of the assembled pivot shaft assembly.
Figure 7:
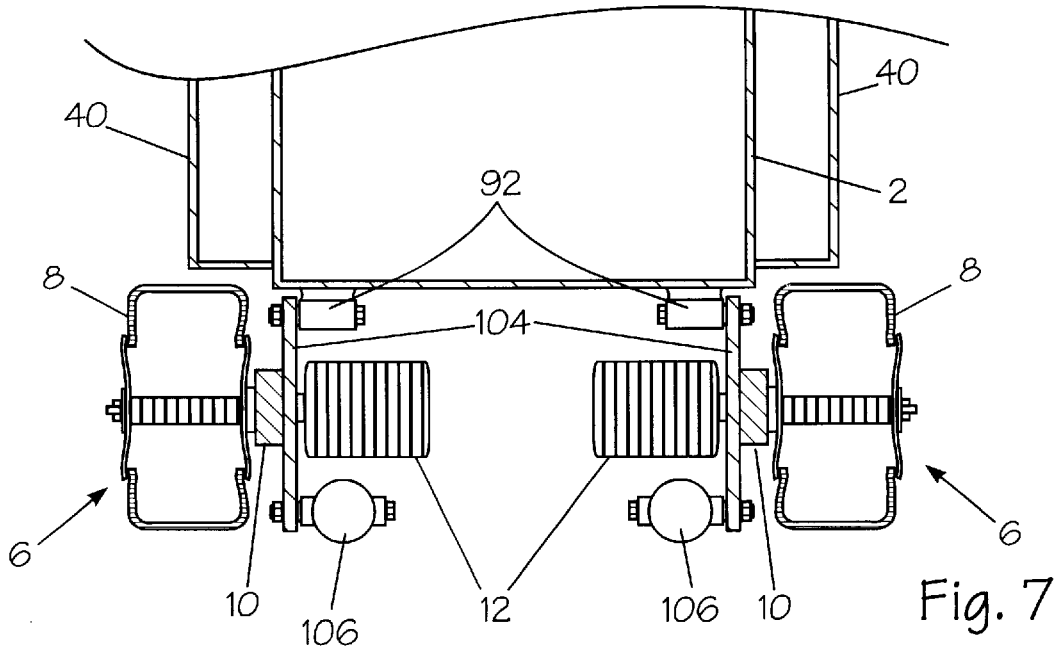
FIG. 7 is a sectional cut away top view of the floating rear frame section constructed in accordance with the present invention.

Referring to the drawings in detail, the apparatus comprises a main body frame 2 and a pair of rear suspension assemblies 4 having left and right rear drive means 6 that support the rear of the body 2. The right and left drive means 6 each comprise at least one wheel 8, a hydraulic axle 10, and a hydraulic drive motor 12 that are attached to the suspension assembly. Hydraulic fluids flowing from hydraulic pumps 14 provide power to each of the independent drive motors 12 to provide a drive means to drive each wheel 8 separately in rearward or forward directions. The present apparatus provides a compact and highly mobile apparatus for removing floor covering 16 that uses an integrated dual hydraulic pump system that separately drives the wheels of the independent right and left rear drive means 6. The apparatus may be piloted in very tight settings, and the mobility of the apparatus makes it much easier to use than the prior art floor covering removers of the type disclosed herein.

In the preferred embodiment, a hydraulic fluid container 18 is integrated onto the top of the body frame 2 for providing a source of fluid to the integrated hydraulics system. Further, in this embodiment an electric motor 20 is utilized to provide power to the hydraulic system. A power cord holder 22 and power cord rotator 24 are also mounted on the rear end of the body frame 2 and a control panel 26 is provided for operating the motor 20.

The comfort of the machine operator is provided for by a seat 28 situated above the frame 2. Foot rests 30 are affixed to the frame 2 for the operator to rest his feet on. As shown, the seat 28 is mounted onto the hydraulic fluid container 18 to maximize the use of space and enhance the compact design of the apparatus. While seated on the seat 28 the operator controls the levers 32 to independently control the rearward and forward direction of the rear drive means 6 of the apparatus. Thereby, the user may begin use of the apparatus to remove floor covering 16 from a floor by using the control panel 26 to initiate the provision of electric or other power to the apparatus.

Depending upon the nature of the floor covering 16, supplemental weight may be needed to add the additional force needed to cause the scraping blade 36 to penetrate the floor covering 16. In prior art machines, weight is added at the front or rear of the machine to control the penetration of the blade 36. However, in the present apparatus, weight plates 38 may be added to weight holders 40 that are integrally attached to the right and left sides of the body frame 2. These side positioned weight holders 40 contribute to reducing the length of apparatus and also help provide for optimum weight and balance of the machine.

The present apparatus includes an integrated hydraulic pump system for driving the wheels 8. Hydraulic fluid is provided to the hydraulic system from the fluid container 18 to a pair of hydraulic pumps 14. Each of the hydraulic pumps 14 of the present invention are integrated into the body frame 2 of the apparatus. The use of two hydraulic pumps 14 reduces stress on each hydraulic pump 14 and provides simple independent control of each drive wheel 8 to assist in maneuvering the apparatus. Each of the hydraulic pumps 14 connect to a fluid forward line 42, a fluid reverse line 44, and an overflow line 46. Each of these lines 42, 44, and 46 connects to a rear hydraulic drive means 6. The fluid forward line 42 provides hydraulic fluid to the drive means for driving the wheels 8 in the forward direction. The fluid reverse line 44 provides hydraulic fluid to the drive means 6 for driving the wheels 8 in the rearward direction. The overflow line 46 provides a re-feed mechanism for overflow of fluid from the fluid container 18.

The hydraulic pumps 14 include a valve plug 48 and a control plug 50. The control plug 50 is connected and linked to the control levers 32 that the operator uses to control the direction of hydraulic fluids driving the wheels 8. The valve plug 48 may be loosened to release the hydraulic fluid pressure within the system and provide a means to allow the drive means 6 to rotate and move freely upon exerting force upon the body frame 2. Free movement of the wheels 8 provides important flexibility in rolling the apparatus short distances.

The hydraulic pumps 14 connect to the motor 20 via pump pulleys 54 and motor pulley 56 on both the hydraulic pumps 14 and on the motor 20. A belt 58 is placed on the pump pulleys 54 and the motor pulley 56 to drive the hydraulic pumps 14. The motor 20 is powered by electrical power provided by through the power cord 60. The power cord 60 connects to the motor control box and runs upward on the power cord holder 22 and is held by the power cord rotator 24 such that the power cord 60 does not interfere with the operation of the device. The motor 20 mounts to the body frame 2 via a reinforced motor mount 62.

The scraping blade 36 for removing floor covering material 16 is attached to the front of the body frame 2 by a blade assembly 64. The blade assembly 64 comprises several features. First, a blade holder frame 66 is connected to the front of body frame 2. The blade holder frame 66 includes a flange 68 on each side thereof having slots 70 that a blade holder 72 is attached to by bolts 74 and that permit the blade holder 72 to slide upward and downward within the slots 70 for adjusting the pitch of the blade holder 72. The blade 36 fits within the blade holder 72 and is clamped down using a pair of bolts 76. The top side of the blade holder 72 is slightly convex to strengthen the hold of the blade holder 72 on the blade 36 and also to allow the use of a wider variety of blade types.

A transport wheel assembly 78 attaches to the body frame 2. The attachment of a transport wheel assembly 78 is helpful in the transport or movement of the apparatus in that it provides a front weight bearing wheel 80 as a supportive transport means for rolling the apparatus. However, the transport wheel assembly 78 is removable so that it is not used during the operation of the apparatus. When removed, the transport wheel assembly 78 places the apparatus in an operating position with the blade 36 in contact with the floor covering 16 to be removed. Detaching the transport wheel assembly 78 reduces the overall length of the apparatus and increases its mobility, which assists in the efficient removal of floor covering 16. Likewise, the removable transport wheel assembly 78 abrogates the need for a permanent front weight bearing wheel affixed to the body frame 2 of the machine; thus further simplifying the construction of the present invention which assists in minimizing the length of the operable machine described herein.

A jack is used to lift the front of the apparatus to attach the transport wheel assembly 78. For convenient access, a removable jack assembly 112 attached to the front of the frame 2 is included in the embodiment of the invention. The transport wheel assembly 78 shown in FIG. 1 attaches to the front of the frame 2 via the blade holder 72 when the front end of the apparatus is lifted by the jack assembly 112. The transport wheel assembly 78 includes an insert 82 that may consist of a flat rigid flange. The insert 82 fits into the blade holder 72 similarly to the blade 36, and the bolts 76 are used to tighten the blade holder 72 about the insert 82 and hold the transport wheel assembly 78 securely in place. A support bar 84 extends from the insert to a wheel rotation shaft 86 that holds the wheel 80 in place by a pair of forks 88 that receive the wheel's 80 axle 90. The wheel 80 freely rotates about the rotation shaft 86 for turning and moving the machine.

Referring now to FIGS. 4 through 8 and in particular FIG. 8, an improved means for causing the rear drives means of the apparatus to float when crossing debris and irregularities in floor surfaces is illustrated. As described the improved floating means comprises a system for permitting a floor cover removal apparatus to have an independent suspension assembly for supporting each drive means 6. Each of the independent suspension assemblies comprises a pivot means by which the drive means 6 float or pivot while the machine operates. As shown in detail in FIGS. 6*a* and 6*b*, the pivot means may consist of pivot shaft assemblies 92. The pivot shaft assemblies 92 are utilized in pivotally connecting each drive means 6 to the rear of the body frame 2 such that each drive means 6 pivots about their respective pivot shaft assembly 92. The pivot shaft assemblies 92 each include a threaded pivot shaft 94 that is adapted to receive ajam nut 96 on each end. As shown in assembly drawing 6*a*, a bearing 98, washer 100, and retaining ring 102 are inserted on the threaded pivot shaft 94 and are retained within a cylinder 108 by the jam nuts 96. The cylinder of each pivot shaft assembly 92 is affixed to the rear of the body frame 2 by welding or other means of securely attaching. Each pivot shaft assembly 92 is attached near a side of the frame 2 to create a wide and stable footprint, and a suspension bar 104 and the drive means 6 are attached to each shaft 94. Each suspension bar 104 is attached to at one end to the pivot shaft assembly 92 via a jam nut 96 such that the suspension bar 104 pivots as the shaft 94 pivots within the cylinder 108. On each suspension bar 104 distally separated from the pivot shaft 94, the drive means 6 is attached to the suspension bar 104 via the drive axle 10. Therefore, as the drive means 6 on either side of the apparatus encounters an uneven surface, the drive means 6 adjusts to the surface by moving the suspension bar 104 as the shaft 94 pivots.

The lower end of a shock absorber 106, such as an air shock, is attached to each suspension bar 104 toward the end of the suspension bar 104 rearward of the pivot shaft assembly 92. The upper end of the shock absorbers 106 attaches to the body frame 2 by means such as a bolt and bracket 110. Thereby, the shock absorbers 106 support the rearward weight of the apparatus by applying force to the suspension bars 104 and lifting the rear of the body frame 2 by the wheels 8.

Figure 8A:
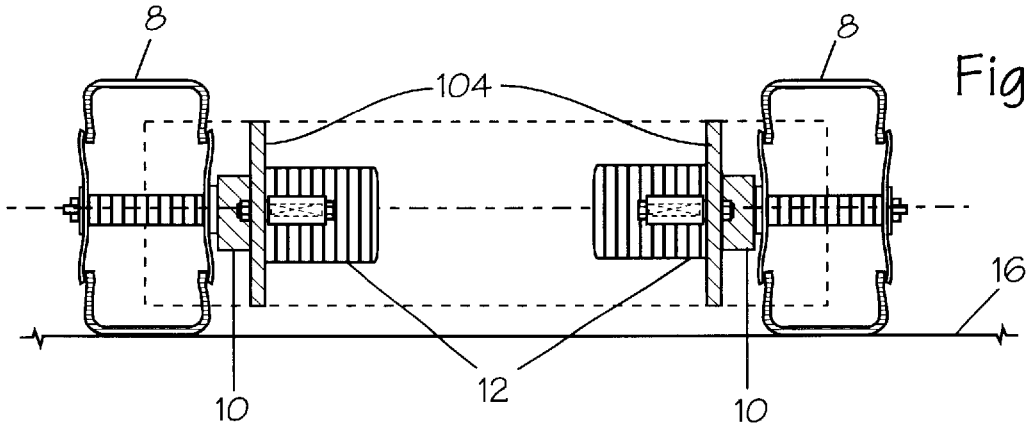
FIG. 8*a* is a sectional cut away front view of the apparatus showing the drive wheels of the apparatus on a level floor surface.
Figure 8B:
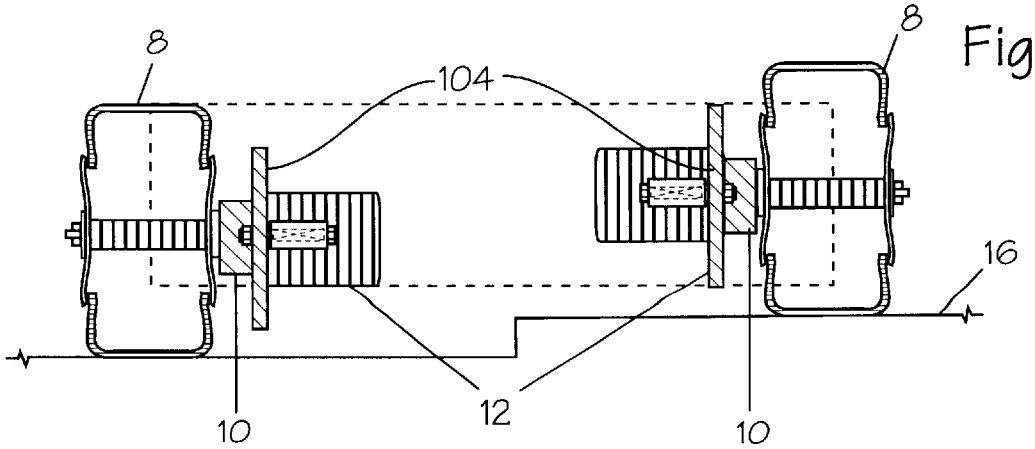
FIG. 8*b* is a sectional cut away front view of the apparatus on an uneven floor surface.

FIG. 8*a* illustrates the condition of the apparatus when the apparatus is operating on a flat floor surface without the rear wheels 8 being affected by the buildup of debris. FIG. 8*b* illustrates the condition of the apparatus when the right rear wheel 8 when viewed from the front is affected by debris. As shown in FIG. 8*b*, the right rear wheel 8 will rise to adjust to the debris buildup without affecting the front of the body frame 2 and the position of the blade 36 that is cutting the floor covering 16. The adjustment of the wheel 8 is caused by the suspension bar 104 pivoting upward with respect to the body frame 2 as the irregular floor surface is encountered.

The primary objective of the novel independent suspension is to maintain the blade 36 under the floor surface 16 being removed. The engagement of the blade 36 is accomplished by keeping the blade 36 in the desired horizontal position with respect to the floor covering 16. Because of the independent suspension, the body frame 2 remains horizontal. Thus, the blade 36 also remains horizontal.

However, still further benefits have been provided by the independent suspension as described by the invention. In particular, the independent suspension beneficially increases the angle of the blade 36 with respect to a floor covering 16 when the machine encounters difficult to remove floor covering. The increased angle of the blade 36 is caused by the inertial force of the machine and the adjustment of the shock absorbers to that inertial force, keeping the blade 36 engaged to the floor covering.

The use of the independent suspension for the rear drive means 6 also permits using advanced techniques for removing difficult floor covering 16. Often floor covering 16 cannot be removed with a normal blade 36 engaging the floor covering 16 with the entire width of the blade 16. Using the inertial forces of the machine, the independent suspension permits the operator to approach difficult floor covering 16 with a slight turn. As the blade 36 approaches, it leads with its comer on the side of the blade 36 of the direction of the turn. Because of the lean of the machine caused by its inertia and adjustment of the suspension, the blade 36 digs into the floor covering 16 using the corner of the blade 36.

Another benefit of using air shock absorbers 106 is that the pressure of the shock absorbers 106 may be adjustable according to the weight of the machine and in accordance with desired operating properties. For instance, the pressure of the air in air shock absorbers 106 could be increased to raise the rear of the machine for increased ground clearance. Controls may be provided on the machine for adjusting the pressure of the air shocks 106 as needed.

While preferred embodiments of the invention have been shown and described, it will be apparent to those skilled in this art that various modification may be made in these embodiments without departing from the spirit of the present invention. For that reason, the scope of the invention is set forth in the following claims.

I claim:

1. An apparatus for removing a floor covering from a floor surface comprising:

a frame mountable by a machine operator during operation having a main body section having a front end and a rear end;

a means for attaching a blade tool to the front end of the frame for engaging the floor covering at an angle;

a pair of independent suspension assemblies attached to the rear end of the frame;

an independent drive means attached to each independent suspension assembly for moving the frame and blade tool with respect to the floor surface;

a means for providing a transport position, and an operating position in which said blade tool is caused by bearing weight to contact and penetrate the floor covering being removed.

2. The apparatus of claim 1 wherein each of said independent suspension assemblies includes a pivot means attached to the rear end of said frame, a suspension bar attached to the pivot means, and a shock absorber attached to said suspension bar and to the rear end of said frame.

3. An apparatus for removing a floor covering from a floor surface comprising:

a frame mountable by a machine operator during operation having a main body section having a front end and a rear end;

a blade holder for attaching a blade tool to the front end of the frame;

a pair of independent suspension assemblies attached to the rear end of the frame;

an independent drive means attached to each independent suspension assembly for moving the frame and blade tool with respect to the floor surface;

a detachable transport wheel having an insert that is attached to the blade holder to provide a transport position and is detached from the blade holder to provide an operating position in which said blade tool contacts the floor covering being removed; and the detachable transport wheel is attached to the blade holder by removing the blade tool from the blade holder and affixing the insert within the blade holder whereby the blade tool is replaced by the insert.

4. An apparatus for removing a floor covering from a floor surface comprising:

a frame mountable by a machine operator during operation having a main body section having a front end and a rear end;

a blade holder for attaching a blade tool to the front end of the frame for engaging the floor covering at an angle;

a pair of independent suspension assemblies attached to the rear end of the frame;

an independent drive motor attached to each independent suspension assembly for moving the frame and blade tool with respect the floor surface while said blade tool is caused by bearing weight to contact and penetrate the floor covering being removed.

* * * * *